US005516012A

United States Patent [19]

Weigel

[11] Patent Number: 5,516,012

[45] Date of Patent: May 14, 1996

[54] APPARATUS FOR STEAM TREATMENT AND HOT-AIR TREATMENT OF GARMENTS

[75] Inventor: Karl-Heinz Weigel, Kaufering, Germany

[73] Assignee: Veit GmbH & Co., Landsberg am Lech, Germany

[21] Appl. No.: 273,913

[22] Filed: Jul. 12, 1994

[30] Foreign Application Priority Data

Jul. 26, 1993 [DE] Germany ..... 9311137 U

[51] Int. Cl.[6] ..... A41H 43/00; D06F 73/00; D04B 7/00

[52] U.S. Cl. ..... 223/51; 223/70; 223/73; 68/5 C; 68/5 E; 68/20

[58] Field of Search ..... 223/51, 52, 70, 223/73, 76; 68/5 C, 5 E, 20; 38/14

[56] References Cited

U.S. PATENT DOCUMENTS

| | | | |
|---|---|---|---|
| 3,805,561 | 4/1974 | Bullak | 68/5 C |
| 3,849,815 | 11/1974 | Frauendorf | 68/5 C |
| 3,921,308 | 11/1975 | Freze | 68/5 C |
| 4,304,053 | 12/1981 | Kellerhals et al. | 68/5 C |
| 4,829,620 | 5/1989 | Christ et al. | 68/20 |
| 5,018,371 | 5/1991 | Riba | 68/5 C |
| 5,046,335 | 9/1991 | Riba | 68/5 E |

FOREIGN PATENT DOCUMENTS

| | | | |
|---|---|---|---|
| 124106 | 8/1931 | Germany | 68/5 C |
| 2915443 | 10/1980 | Germany . | |
| 3019243 | 12/1980 | Germany . | |
| 3119664 | 12/1982 | Germany . | |
| 3119560 | 12/1982 | Germany . | |
| 89 03 655.7 | 11/1989 | Germany . | |
| 2025019 | 1/1980 | United Kingdom . | |

*Primary Examiner*—C. D. Crowder
*Assistant Examiner*—Bibhu Mohanty
*Attorney, Agent, or Firm*—Foley & Lardner

[57] ABSTRACT

Apparatus for steam treatment and hot-air treatment of garments hanging on a conveyor by clothes hangers in a housing, into which the garments are introduced through an inlet lock and from which the garments are removed through an outlet lock. There is provided in the housing, after the inlet lock in the conveying direction, a steam treatment section with steam outlet nozzles directed onto the garments on both sides of the conveying path. After the steam treatment section in the conveying direction, a hot-air treatment section with at least one inlet opening is provided, which opening introduces hot air into the housing. At least one outlet opening is also provided, which removes hot air from the housing. The inlet and outlet opening are part of an air-circulation circuit system. At least one outlet opening is also provided, which removes hot air from the housing. The steam treatment section passes directly—without an intermediate lock or the like—into the hot-air treatment section and, in a transition region of the two sections, at least one aspirating opening of at least one branch line which opens in the air-circulation circuit system is provided.

18 Claims, 2 Drawing Sheets

APPARATUS FOR STEAM TREATMENT AND HOT-AIR TREATMENT OF GARMENTS

BACKGROUND OF THE INVENTION

1. Field of the Invention

The present invention relates to an apparatus for steam treatment and hot-air treatment of garments hanging on a conveyor. The garments are introduced into a treatment housing through an inlet lock and the garments are removed through an outlet lock.

2. Description of Related Art

Apparatuses for steam and hot-air treatment are known, in particular in cleaning firms. They allow solvents which are used in cleaning, in particular per compounds (i.e., halogenated hydrocarbon solvent), to be extracted from the garments. The apparatus also facilitates, independently of extraction, subsequent ironing of the garments. In these apparatuses there is provided in the housing, after the inlet lock in the conveying direction, a steam treatment section. Steam outlet nozzles are directed onto the garments on both sides of the conveying path. After the steam treatment section there is provided in the conveying direction, a hot-air treatment section with an inlet opening and an outlet opening. The inlet opening introduces hot air into the housing, and the outlet opening removes hot air from the housing. The inlet and outlet opening are part of an air-circulation circuit system.

In the known apparatuses, the steam treatment section is separated from the hot-air treatment section by an intermediate lock. This makes the construction of the apparatuses expensive and cumbersome.

SUMMARY OF THE INVENTION

One object of the present invention is to provide a steam and hot-air treatment apparatus of the type mentioned above which renders an intermediate sealing means such as a lock or the like superfluous.

In accomplishing the foregoing object, there has been provided according to one aspect of the present invention an apparatus for steam and hot-air treatment of garments. The apparatus includes: (i) a housing; (ii) a sealing inlet opening located at one end of the housing; (iii) a sealing outlet opening located at another end of the housing; (iv) a conveyor extending through the housing for transporting the garments through the inlet, through the housing, and out the outlet; (v) a steam treatment section located in the housing; (vi) steam nozzles located in the steam treatment section for directing steam onto the garments; (vii) a hot-air treatment section located in the housing downstream of the steam treatment section in the conveying direction of the garments; (viii) an air-circulation circuit system for providing air to the hot-air treatment system, the air-circulation circuit system includes at least one inlet opening for introducing air into the housing and at least one outlet opening for removing air from the housing; (ix) a transition region defined by the adjacent ends of the steam and hot-air treatment section; and (x) at least one branch line which defines at one end thereof at least one aspirating opening located in the transition region, and the at least one branch line opening into the air-circulation system.

In a preferred embodiment, there is no sealing arrangement, such as an intermediate lock or the like, located between the steam treatment section and the hot-air treatment section.

Further objects, features and advantages of the present invention will become apparent from the detailed description of preferred embodiments which follows.

DETAILED DESCRIPTION OF THE PREFERRED EMBODIMENTS

The present invention comprises a treatment apparatus that includes a steam treatment section that passes directly into the hot-air treatment section without an intermediate sealing means such as a lock or the like. In a transition region of the two sections, at least one aspirating opening of at least one branch line, which opens in an air-circulation circuit system, is provided.

In order to heat up the steam aspirated through the at least one branch line without heat loss, the apparatus preferably has the at least one branch line opening into the air-circulation circuit system in the region of, or slightly upstream of, a heating means for the hot air. The heating means can be any suitable apparatus for heating air.

Since too much steam is occasionally aspirated and could pass into the hot-air treatment section, the apparatus includes a removal line which is attached to the at least one branch line. In the region of the attachment point, a diverter is arranged, which allows the steam aspirated through the aspirating opening to be conducted at least in part into the removal line.

Since the speed of passage of the garments through the housing is essentially fixed but the duration of treatment with steam is preferably shorter than the duration of treatment with hot air, the apparatus preferably has the steam treatment section occupying approximately and the ⅓ hot-air treatment section accordingly occupying approximately ⅔ of the length of the housing in the conveying direction.

Figure 1:
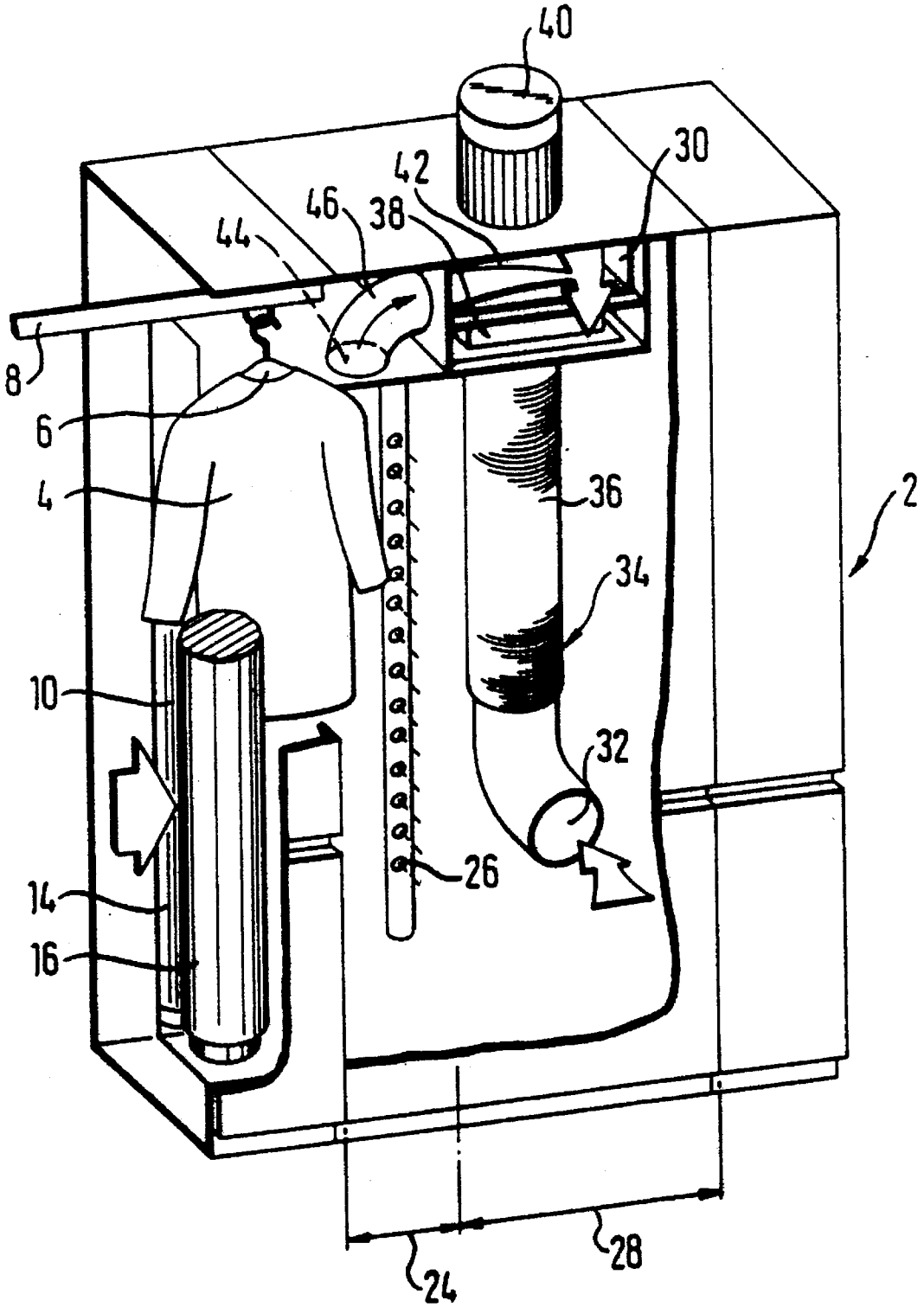
FIG. 1 shows a perspective view of an apparatus according to the invention, partially cut away.
Figure 2:
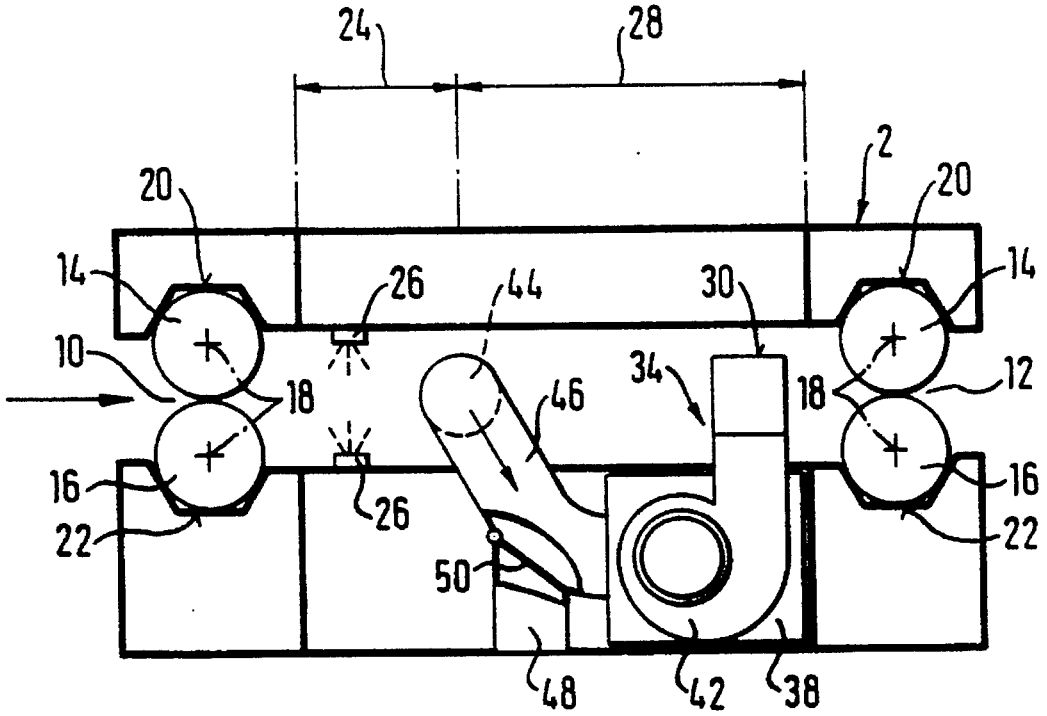
FIG. 2 shows a horizontal section through the upper region of the apparatus according to FIG. 1 viewed from above.

The invention is more fully described below in an exemplary embodiment with reference to FIGS. 1 and 2. The apparatus according to the exemplary embodiment has a housing 2, into which garments 4 which hang on clothes hangers 6 are introduced through an inlet lock 10 by means of a conveyor 8 and from which the garments 4 are correspondingly removed through an outlet lock 12. Each lock includes a pair of rollers 14, 16 inflated with air with vertical axes 18, which rollers are faced by lateral sealing surfaces 20, 22 of the housing 2 and between which rollers the garments 4 are to be conveyed into the housing 2 and out of the housing 2. Although locks are preferable, any suitable type of sealing means can be used.

Provided in the housing 2, behind the inlet lock 10 in the conveying direction, is a steam treatment section 24 with steam outlet nozzles 26. The nozzles 26 are directed onto the garments 4 on both sides of the conveying path of the garments 4. In the present embodiment, these steam outlet nozzles 26 are in each case arranged in a row one above another on each side of the conveying path of the garments 4. However, any suitable nozzle arrangement can be used. Situated behind the steam treatment section 24 in the conveying (downstream) direction of the garments 4 is a hot-air treatment section 28. The hot-air treatment section has an air-circulation circuit system 34. The air-circulation circuit system includes an inlet opening 30, which introduces hot air in an upper region of the housing 2, and an outlet opening 32, which removes hot air from the housing 2. The air-circulation circuit system also includes a section 36, in which a heating device 38 and a blower 42, which is driven by a motor 40, are arranged one behind the other in the air flow direction. The steam treatment section 24 passes directly—without an intermediate lock or the like— into the hot-air treatment section 28. In a transition region comprising the adjacent regions of two sections 24, 28, an aspirating opening 44 is provided. The aspirating opening is connected to at least one branch line 46 which opens into the air-circulation circuit system 34 in the region of the heating apparatus 38. The aspirating opening 44 preferably lies in the upper region of the housing 2 and is directed downward. Attached to at least one branch line 46 is a removal line 48 (FIG. 2). Situated in the region of the attachment point is a flap 50, by means of which the steam aspirated through the aspirating opening 44 can be conducted at least in part into the removal line according to the position of the flap 50. The position of the flap is infinitely adjustable. Although a flap is preferred, any suitable valve means or sealing means can be used.

The steam treatment section occupies approximately ⅓ and the hot-air treatment section 28 accordingly approximately ⅔ of the length of the housing 2 in the conveying direction.

Other embodiments of the invention will be apparent to those skilled in the art from consideration of the specification and practice of the invention disclosed herein. It is intended that the specification be considered as exemplary only, with the true scope and spirit of the invention being indicated by the following claims.

What is claimed is:

1. An apparatus for steam and hot-air treatment of garments, said apparatus comprising:

a housing;

a sealing inlet opening located at one end of said housing;

a sealing outlet opening located at another end of said housing;

a conveyor extending through said housing for transporting said garments through said inlet, through said housing, and out said outlet;

a steam treatment section located in said housing;

steam nozzles located within said steam treatment section for directing steam onto said garments;

a hot-air treatment section located in said housing downstream of said steam treatment section in the conveying direction of said garments;

an air-circulation circuit system for providing air to said hot-air treatment system, said air-circulation circuit system including at least one inlet opening for introducing air into said housing and at least one outlet opening for removing air from said housing;

a transition region defined by adjacent ends of said steam and hot-air treatment section;

at least one branch line which defines at one end thereof at least one aspirating opening located entirely within said transition region for localized removal of air from said transition region and being spaced from said inlet opening of said air circulation circuit system, said at least one branch line opening into said air-circulation system.

2. The apparatus as claimed in claim 1, wherein said steam treatment section and said hot-air treatment sections directly abut one another.

3. The apparatus as claimed in claim 1, further comprising a heating means located in said air-circulation circuit system.

4. The apparatus as claimed in claim 3, wherein said at least one branch line opens into said air-circulation circuit system at a location in the vicinity of said heating means.

5. The apparatus as claimed in claim 3, wherein said at least one branch line opens into said air-circulation circuit system at a location slightly upstream of said heating means, in the direction of air flow through said air-circulation circuit system.

6. The apparatus as claimed in claim 1, said apparatus further comprising:

a removal line attached to said at least one branch line; and a diverter arranged in the region where said removal line is attached to said at least one branch line, for diverting steam aspirated into said aspirating opening through said removal line.

7. The apparatus as claimed in claim 6, wherein said diverter is infinitely adjustable between an open and closed position.

8. The apparatus as claimed in claim 1, wherein said steam treatment section occupies approximately ⅓ of said apparatus, and said hot-air treatment section occupies approximately ⅔ of said apparatus.

9. The apparatus as claimed in claim 1, wherein there is no sealing arrangement located between said steam treatment section and said hot-air treatment section.

10. The apparatus as claimed in claim 1, wherein there is no intermediate lock located between said steam treatment section and said hot-air treatment section.

11. An apparatus for steam and hot-air treatment of garments, said apparatus comprising:

a housing;

a sealing inlet opening located at one end of said housing;

a sealing outlet opening located at another end of said housing;

a conveyor extending through said housing for transporting said garments through said inlet, through said housing, and out said outlet;

a steam treatment section located in said housing;

steam nozzles located within said steam treatment section for directing steam directly onto said garments;

a hot-air treatment section located in said housing downstream of said steam treatment section in the conveying direction of said garments;

an air-circulation circuit system for providing air to said hot-air treatment system, said air-circulation circuit system including at least one inlet opening for introducing air into said housing and at least one outlet opening for removing air from said housing;

a transition region defined by adjacent ends of said steam and hot-air treatment section;

at least one branch line which defines at one end thereof at least one aspirating opening entirely located within said transition region, said at least one branch line opening into said air-circulation system.

12. The apparatus as claimed in claim 11, wherein said steam treatment section and said hot-air treatment sections directly abut one another.

13. The apparatus as claimed in claim 11, further comprising a heating means located in said air-circulation circuit system.

14. The apparatus as claimed in claim 13, wherein said at least one branch line opens into said air-circulation circuit system at a location in the vicinity of said heating means.

15. The apparatus as claimed in claim 13, wherein said at least one branch line opens into said air-circulation circuit system at a location upstream of said heating means, in the direction of air flow through said air-circulation circuit system.

16. The apparatus as claimed in claim 11, said apparatus further comprising:

a removal line attached to said at least one branch line; and a diverter arranged in the region where said removal line is attached to said at least one branch line, for diverting steam aspirated into said aspirating opening through said removal line.

17. The apparatus as claimed in claim 16, wherein said diverter is infinitely adjustable between an open and closed position.

18. The apparatus as claimed in claim 11, wherein said aspirating opening is disposed in a position above said steam nozzles.

* * * * *